US008419238B2

(12) United States Patent
Robinson

(10) Patent No.: US 8,419,238 B2
(45) Date of Patent: Apr. 16, 2013

(54) LIGHTING FIXTURES HAVING ENHANCED HEAT SINK PERFORMANCE

(75) Inventor: Joel E. Robinson, Charlevoix, MI (US)

(73) Assignee: A.L.P. Lighting & Ceiling Products, Inc., Niles, IL (US)

( * ) Notice: Subject to any disclaimer, the term of this patent is extended or adjusted under 35 U.S.C. 154(b) by 476 days.

(21) Appl. No.: 12/725,131

(22) Filed: Mar. 16, 2010

(65) Prior Publication Data

US 2011/0228550 A1 Sep. 22, 2011

(51) Int. Cl.
*F21V 15/00* (2006.01)

(52) U.S. Cl.
USPC . 362/373; 362/294; 362/249.02; 362/311.02; 362/311.06; 362/345; 362/264

(58) Field of Classification Search ..... 362/373, 362/294, 555, 580, 218, 222, 223, 217.05, 362/217.13, 217.17, 249.02, 235, 264, 311.02, 362/311.06, 345; 361/679.54, 703–704, 361/709–710; 165/185
See application file for complete search history.

(56) References Cited

U.S. PATENT DOCUMENTS 5,743,634 A 4/1998 Sitzema et al.
5,745,632 A * 4/1998 Dreyer ..... 385/133
7,611,264 B1 * 11/2009 Chang et al. ..... 362/249.02
2002/0114168 A1 * 8/2002 Pelka et al. ..... 362/555
2009/0147518 A1 * 6/2009 Shuai et al. ..... 362/249.02

FOREIGN PATENT DOCUMENTS

DE 20114086 U1 * 1/2002
KR 2009105797 A * 10/2009

OTHER PUBLICATIONS http://www.acuitybrandslighting.com/Library/Documents/HLP/Productc%20Brochure/Washington%20Postlite%20-%20Acrylic/WashingtonPostLiteAcrylic.pdf.
http://www.lumec.com/downloads/brochures.html http://www.lumec.com/pdf/series/Serenade_series.pdf.
http://www.lumec.com/downloads/brochures.html http://www.lumec.com/pdf/series/Westminster_series.pdf.
http://www.springcity.com/images/spring_city_led_brochure_3.pdf.

* cited by examiner

*Primary Examiner* — Sharon Payne
(74) *Attorney, Agent, or Firm* — Joan Pennington

(57) ABSTRACT

Lighting fixtures having an enhanced heat sink performance are provided. A heat sink member is a unitary ring member. An outside surface of the heat sink member is disposed exterior of the lighting fixture and includes a plurality of outwardly extending fins. An inside surface of the heat sink member is disposed inside of the lighting fixture and includes a plurality of surfaces configured for mating engagement with a respective light source board. The heat sink member joins upper and lower globe portions of the lighting fixture. A reflector or a light pipe optionally is provided interior of the light fixture, providing illumination directional control. A polygon shaped lighting fixture provides a LED light output to cross in a plane proximate to a light center of the fixture.

22 Claims, 17 Drawing Sheets

LIGHTING FIXTURES HAVING ENHANCED HEAT SINK PERFORMANCE

FIELD OF THE INVENTION

The present invention relates generally to lighting fixtures and luminaires, and more particularly, relates to a lighting fixture having enhanced heat sink performance with a heat sink member connecting upper and lower portions of an outdoor lighting globe.

DESCRIPTION OF THE RELATED ART

Today many companies are offering decorative outdoor light emitting diode (LED) retrofit kits and new LED fixtures in order to take advantage of the long life, excellent color and beam control and other benefits of LEDs. LEDs are temperature sensitive and generate a significant amount of heat, which must be removed from the fixture in order to assure long life and adequate illumination.

To date, manufacturers have placed LEDs on heat sinks, which are either inside the optical and/or housing area or are mounted to an opaque metal top to provide heat extraction from the fixture. The problem with these designs is that much of the heat remains trapped inside the optical cavity and limits the wattage of the LED light engine and therefore the total lumen package is less than is required for many applications. To date, no solution has been developed to provide for a luminous globe, wherein the top and bottom both emit light and have an external heat sink adequate to dissipate significant wattage.

High power LEDs are also very bright and it is both unappealing in a decorative application and, due to glare, poor for visibility that the individual LEDs should be visible as points of light.

Conventional arrangements of globes with LEDs mounted to heat sinks inside the optical cavity do a poor job of hiding the LED due to the proximity of the LED to the surface of the globe. Such conventional arrangements trap the heat from the light engine inside the globe and do not mimic traditional light sources for which the globes were designed.

Conventional arrangements of globes with heat sinks mounted in the top have opaque tops and do not mimic the desired appearance of luminous globes. Further, the fixture tops are usually inferior heat sinks or compromise beam spread in order to accommodate the aesthetic design.

Other conventional arrangements of globes with heat sinks in the base have limited surface area, inferior heat dissipation and generally require more optical elements, decreasing efficiency.

A need exists for a new lighting fixture that employs a heat sink and light distribution, which preserves and enhances the aesthetic design of the luminous globe while optimizing heat extraction and providing a configuration for maximizing optical performance.

SUMMARY OF THE INVENTION

A principal aspect of the present invention is to provide a lighting fixture having an enhanced heat sink performance. Other important aspects of the present invention are to provide such lighting fixture substantially without negative effect and that overcome many of the disadvantages of prior art arrangements.

In brief, a lighting fixture having an enhanced heat sink performance is provided. A heat sink member is a unitary ring member. An outside surface of the heat sink member is disposed exterior of the lighting fixture and includes a plurality of outwardly extending fins. An inside surface of the heat sink member is disposed inside of the lighting fixture and includes a plurality of surfaces configured for mating engagement with a light source boards. The heat sink member joins upper and lower globe portions of the lighting fixture.

In accordance with features of the invention, the lighting fixture includes an outdoor lighting globe. The heat sink member is formed of a thermally conductive material, such as aluminum. The unitary ring member and the outwardly extending vertical fins have a selected size and configuration for providing enhanced heat sink performance.

In accordance with features of the invention, the outwardly extending fins are outwardly extending vertical fins integrally formed with the unitary ring member. Each of the light source boards includes a predefined number of light emitting diodes (LEDs). The light source board includes a metal core circuit board.

In accordance with features of the invention, a light pipe is used to redirect the LED light output. The light pipe includes a selected one of a fibre optic light pipe, and an acrylic light pipe.

In accordance with features of the invention, a reflector is provided inside the lighting fixture below the heat sink member to redirect the LED light output. The reflector includes a predefined contour to provide directional illumination control.

In accordance with features of the invention, another reflector is provided inside the lighting fixture above the heat sink member to redirect the LED light output. The reflector includes a predefined contour and a plurality of slots to provide an upper controlled illumination component and also to provide a lower directional illumination control.

In accordance with features of the invention, mating surface portions are configured for mating engagement with a respective light source boards that are canted at an angle to direct a LED light output proximate to a point on a light center of the fixture.

In accordance with features of the invention, a polygon shaped lighting fixture provides a LED light output to cross in a plane proximate to a light center of the fixture.

In accordance with features of the invention, a plurality of mounting clips are provided with the heat sink member to connect the upper and lower globe portions of the lighting fixture.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
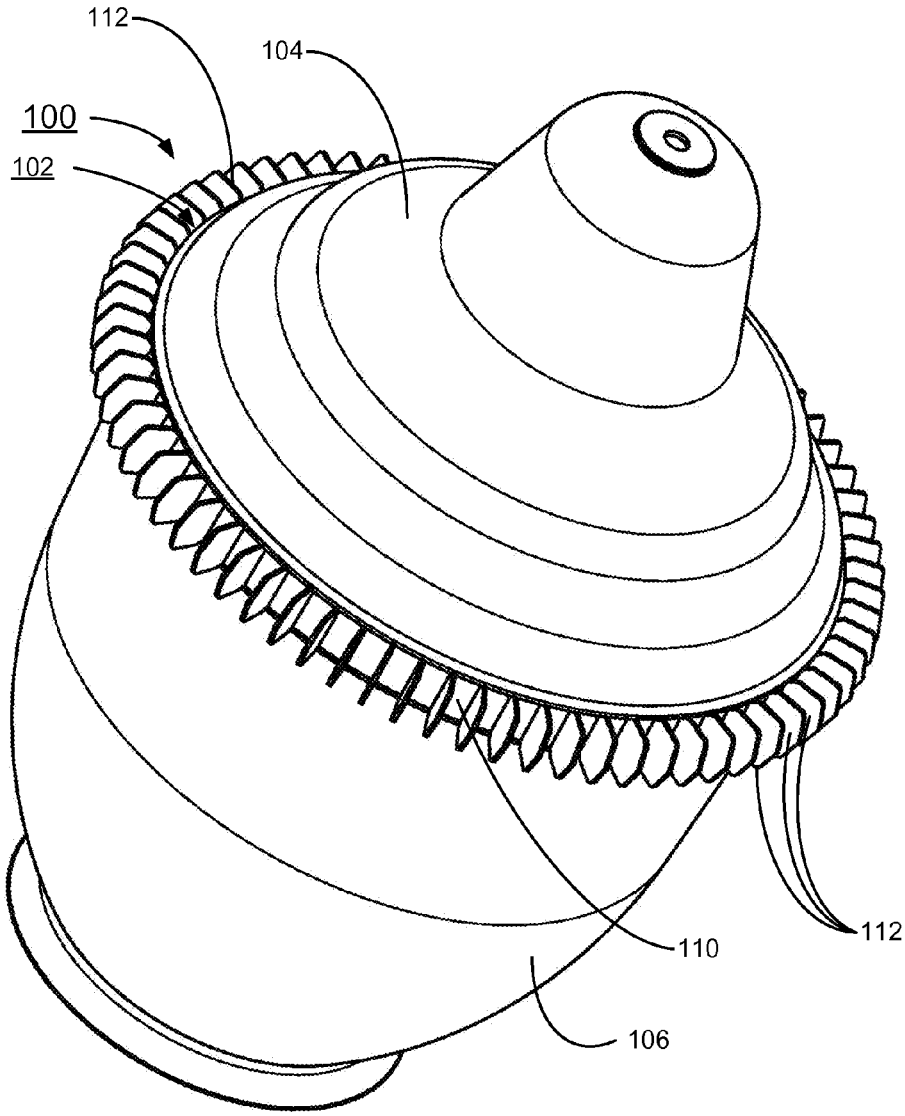
FIGS. 1 and 2 are respective top and bottom perspective views illustrating a lighting fixture in accordance with the preferred embodiment.
Figure 2:
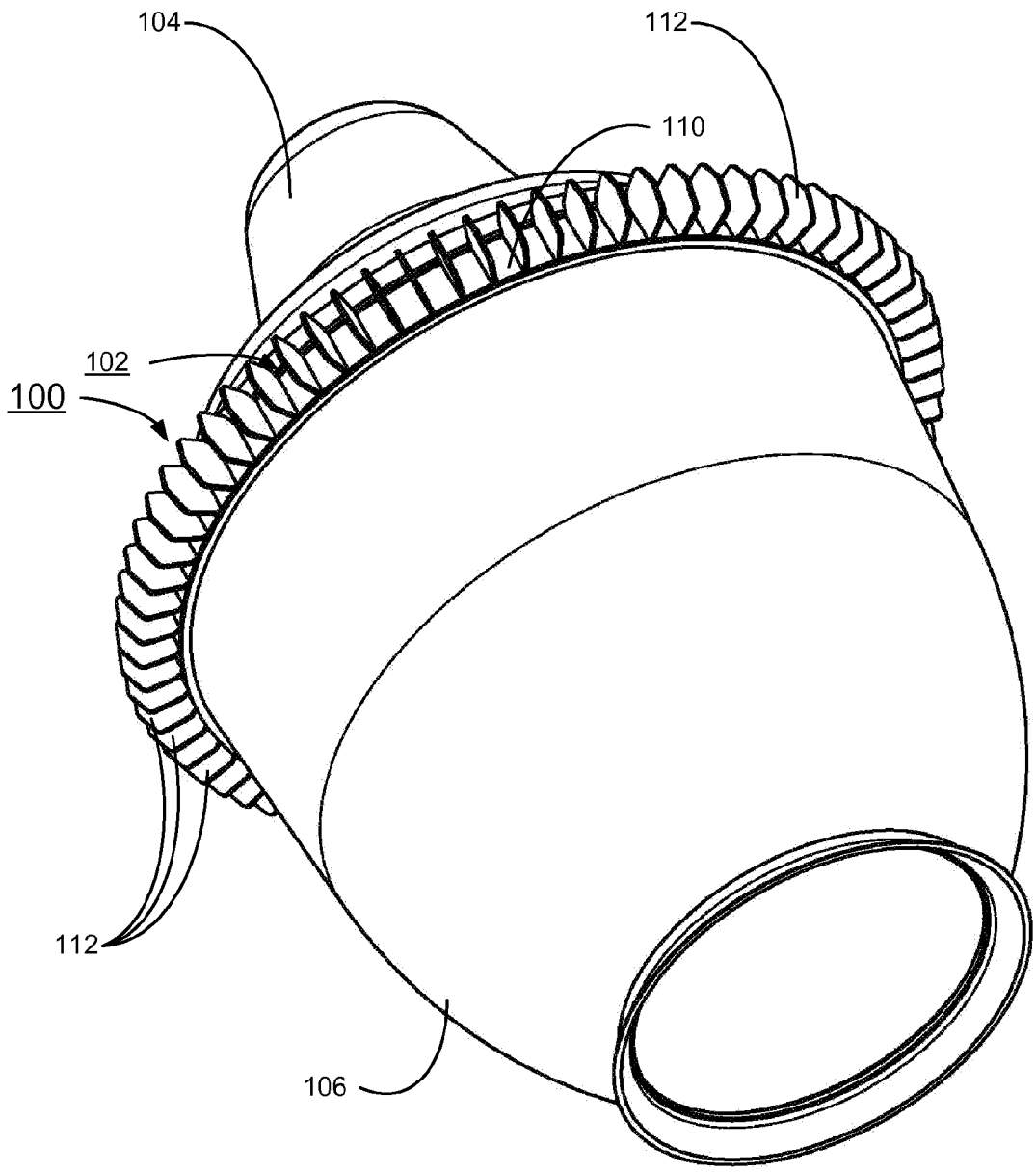
Figure 3:
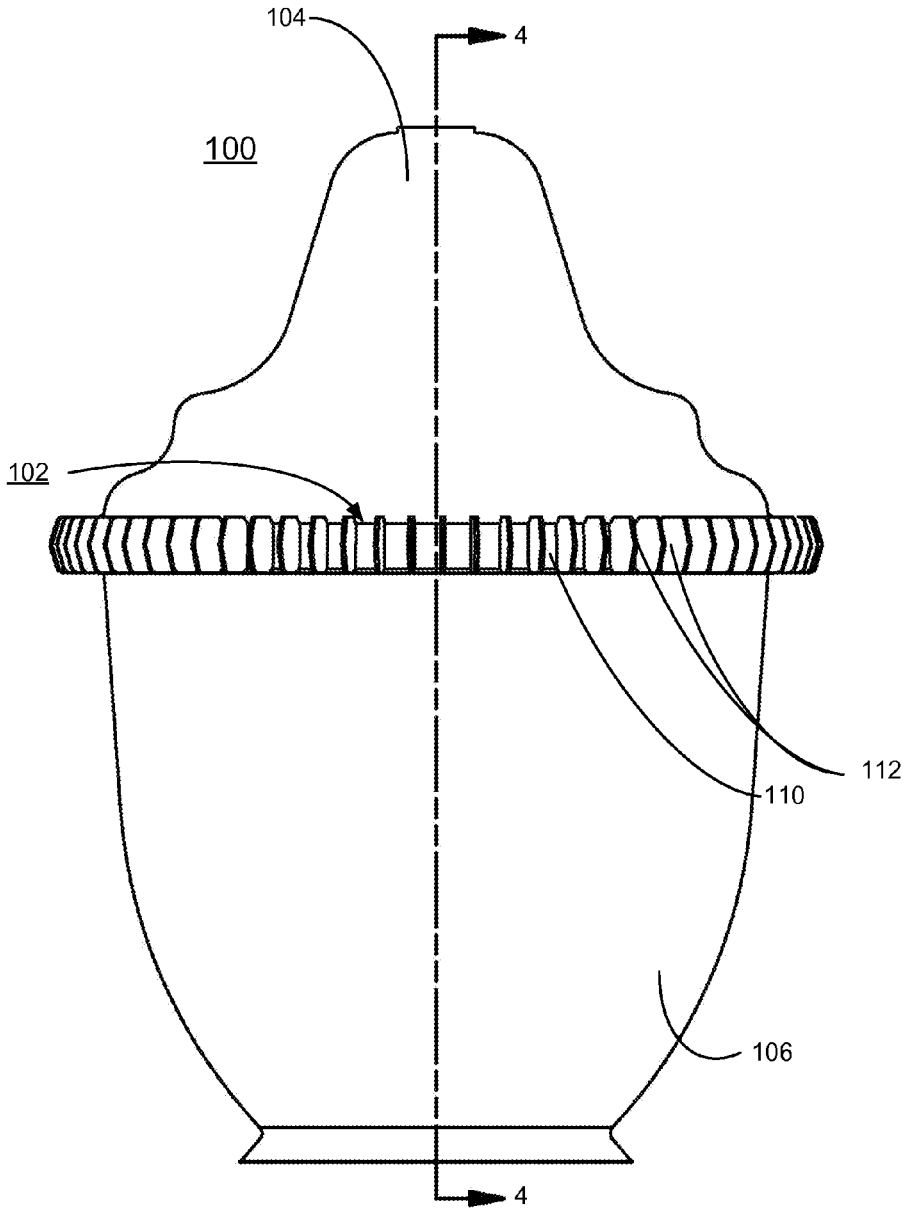
FIG. 3 is a front view illustrating the lighting fixture of FIGS. 1 and 2 in accordance with the preferred embodiment.
Figure 4:
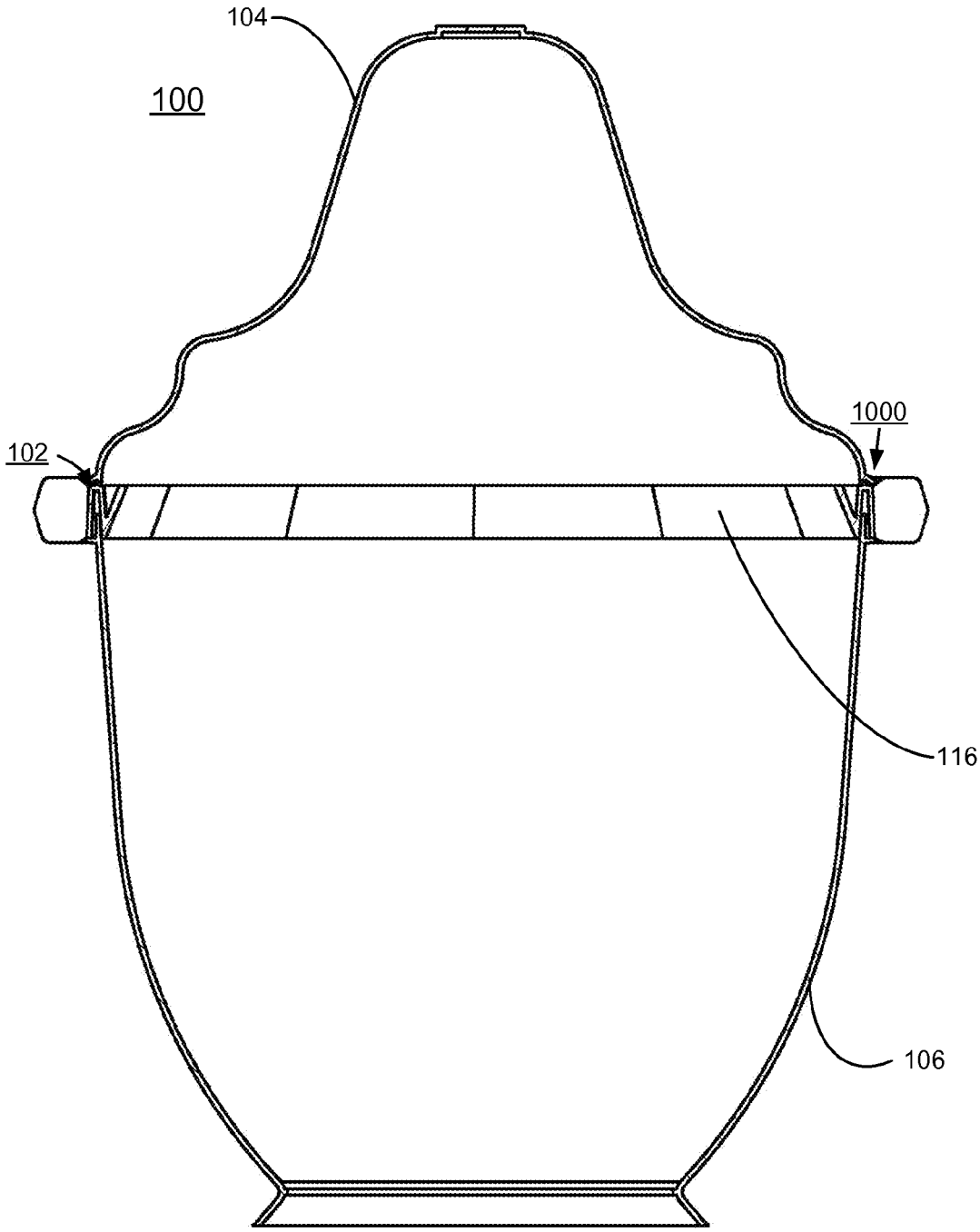
FIG. 4 is a sectional view taken along line 4-4 of FIG. 3 illustrating the lighting fixture in accordance with the preferred embodiment.

In accordance with features of the invention, a lighting fixture having an enhanced heat sink performance is provided. A unitary heat sink member includes a plurality of outwardly extending fins having a selected size and configuration for providing enhanced heat sink performance.

Having reference now to the drawings, in FIGS. 1-7, there is shown a lighting fixture generally designated by the reference character 100 in accordance with the preferred embodiment. Lighting fixture 100 includes a heat sink member generally designated by the reference character 102 in accordance with the preferred embodiment. Lighting fixture 100 includes an upper globe portion 104 and a lower globe portion 106, for example, of an outdoor lighting globe 100.

Figure 5:
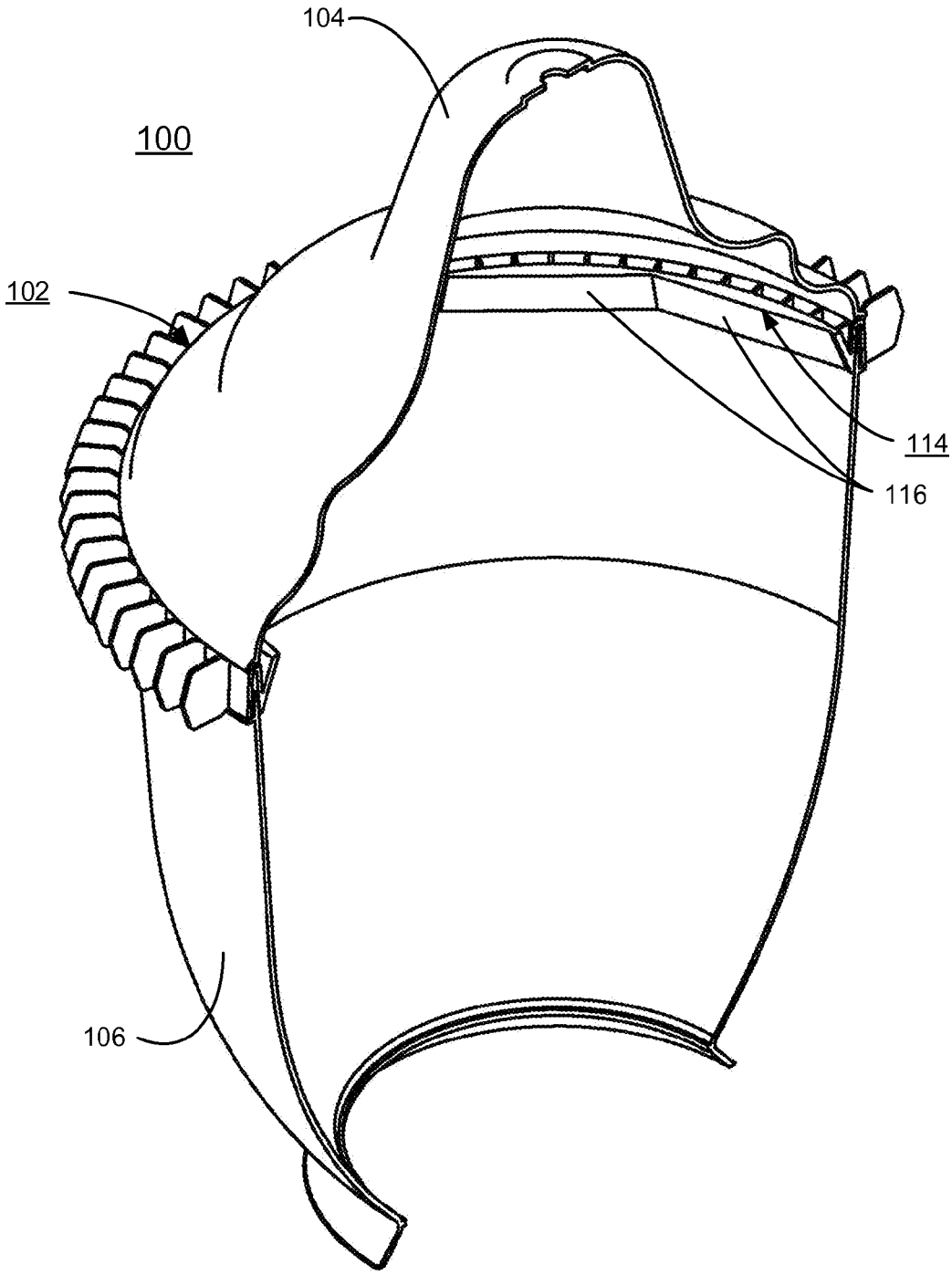
FIG. 5 is a fragmentary perspective sectional view illustrating the lighting fixture of FIGS. 1 and 2 in accordance with the preferred embodiment.
Figure 6:
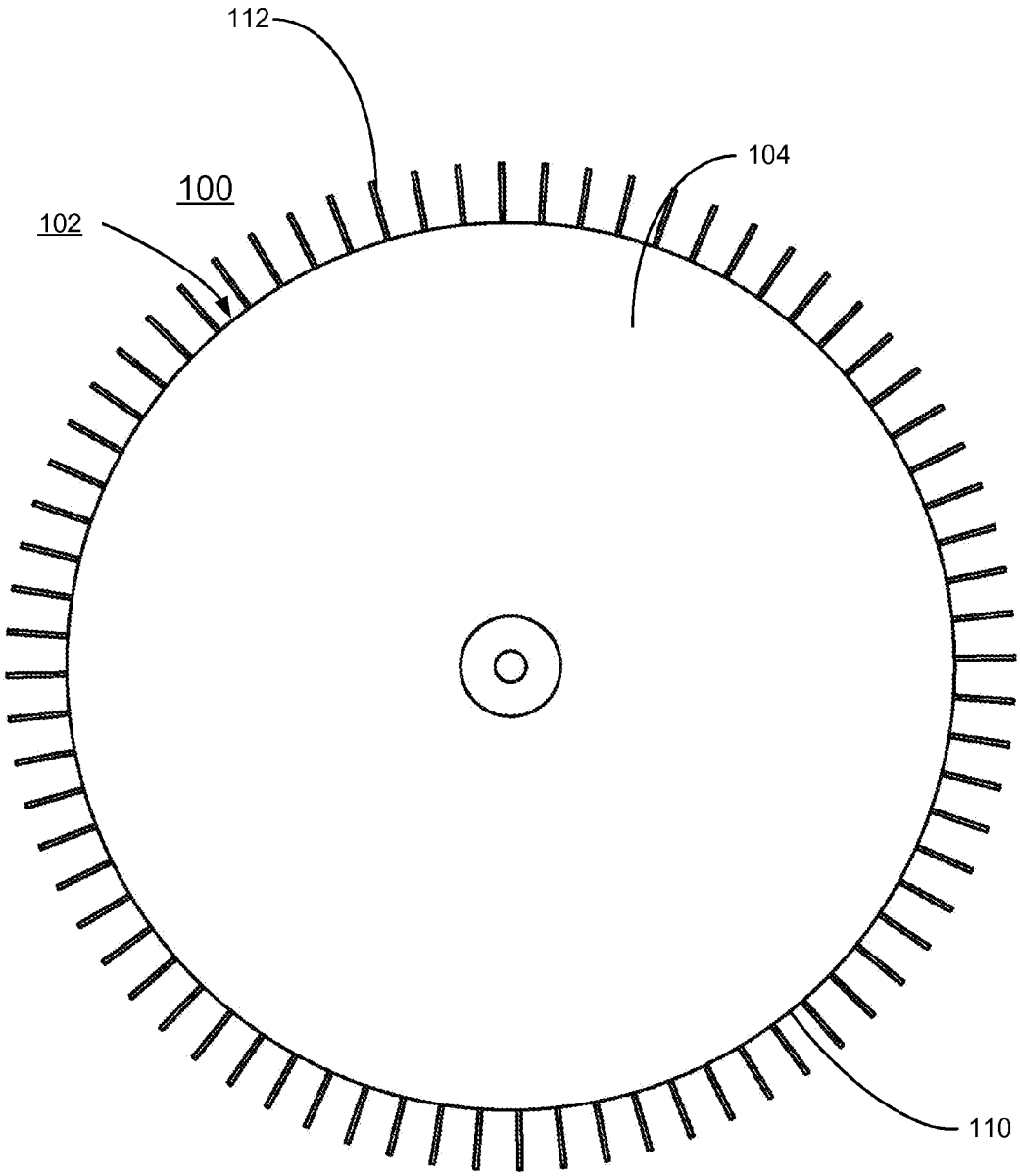
FIG. 6 is a top plan view illustrating the lighting fixture of FIGS. 1 and 2 in accordance with the preferred embodiment.
Figure 7:
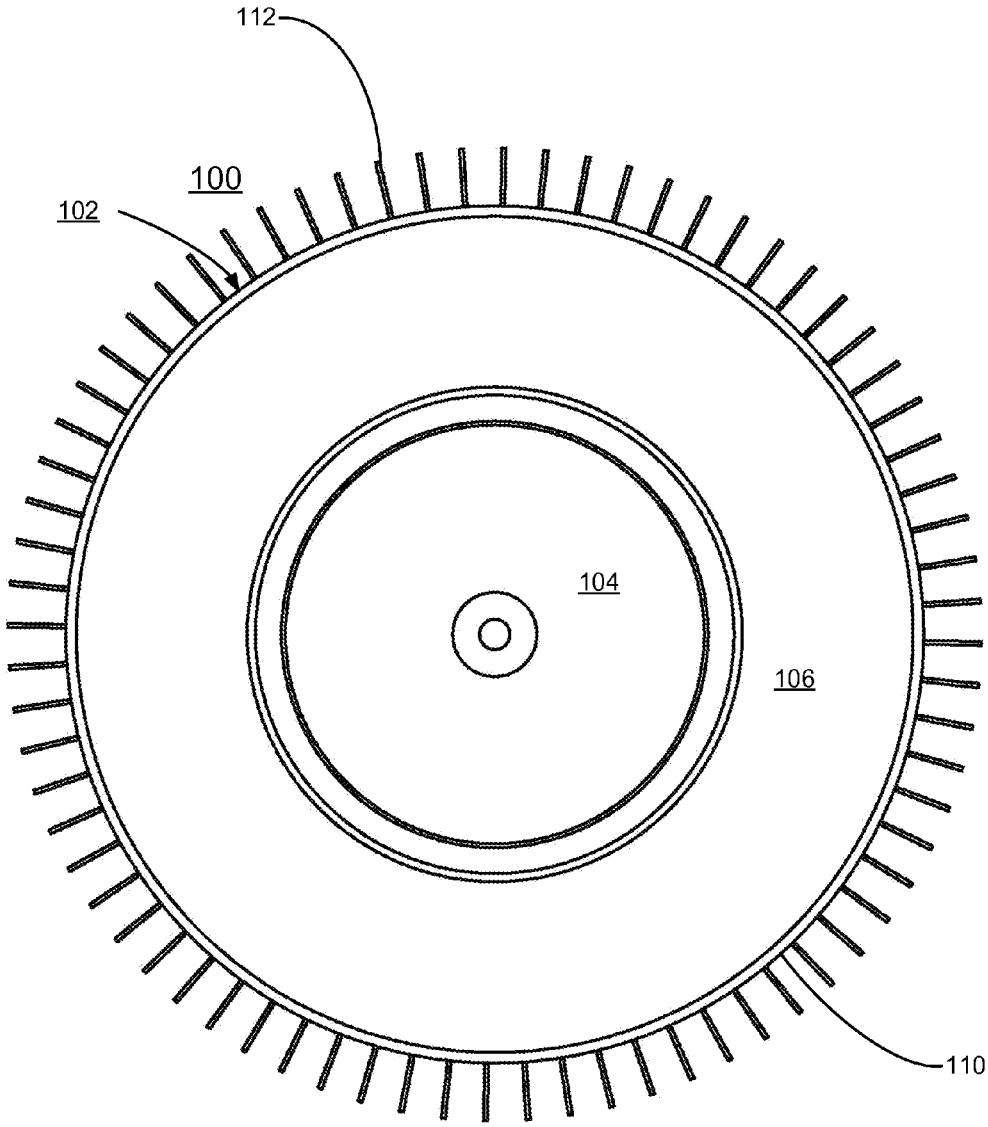
FIG. 7 is a top plan view illustrating the lighting fixture of FIGS. 1 and 2 in accordance with the preferred embodiment.

The heat sink member 102 includes a unitary band or ring member, which joins the upper globe portion 104 and lower globe portion 106. An exterior surface 110 of the heat sink ring member 102 is disposed exterior of the lighting fixture 100 and is exposed to the air for optimal cooling. The exterior surface 110 of the heat sink member 102 includes a plurality of integrally formed, outwardly extending vertical exterior fins 112 for enhanced thermal transfer performance. As illustrated in FIG. 5, an inside surface 114 of the heat sink member 102 has predetermined surfaces 116 which allow selective positioning of the LEDs (not shown in FIG. 5) to provide optimal performance.

The heat sink member 102 is formed of a selected thermally conductive material, such as cast aluminum and is either painted or anodized to protect the heat sink member from corrosion. The heat sink member 102 also can be formed of copper or other metal. The outwardly extending vertical exterior fins 112 of the heat sink member 102 have a selected size and arrangement, for example, 2.25" tall and 0.65" wide, spaced, 0.49" apart, and has a combined total of 330 square inches of surface area.

The upper globe portion 104 and lower globe portion 106 are formed of a substantially transparent light transmitting material, such as an acrylic or similar material. The upper globe portion 104 and lower globe portion 106 are implemented, for example, with an A.L.P. LexaLite Model 424 top and a LexaLite Model 424, manufactured and sold by A.L.P. Lighting & Ceiling Products, Inc. of Niles, Ill.

Figure 8:
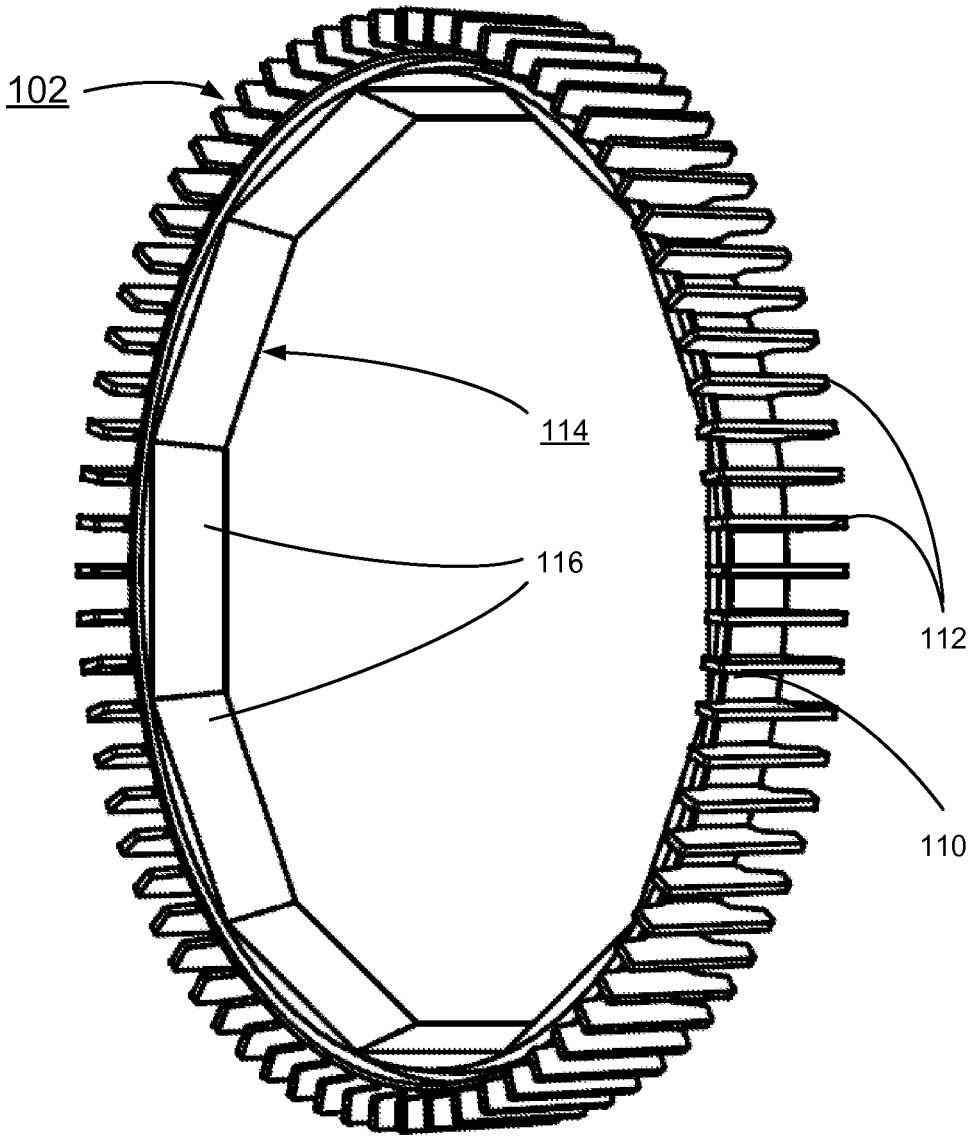
FIG. 8 is a perspective sectional view illustrating the heat sink member of the lighting fixture of FIGS. 1 and 2 in accordance with the preferred embodiment.
Figure 9:
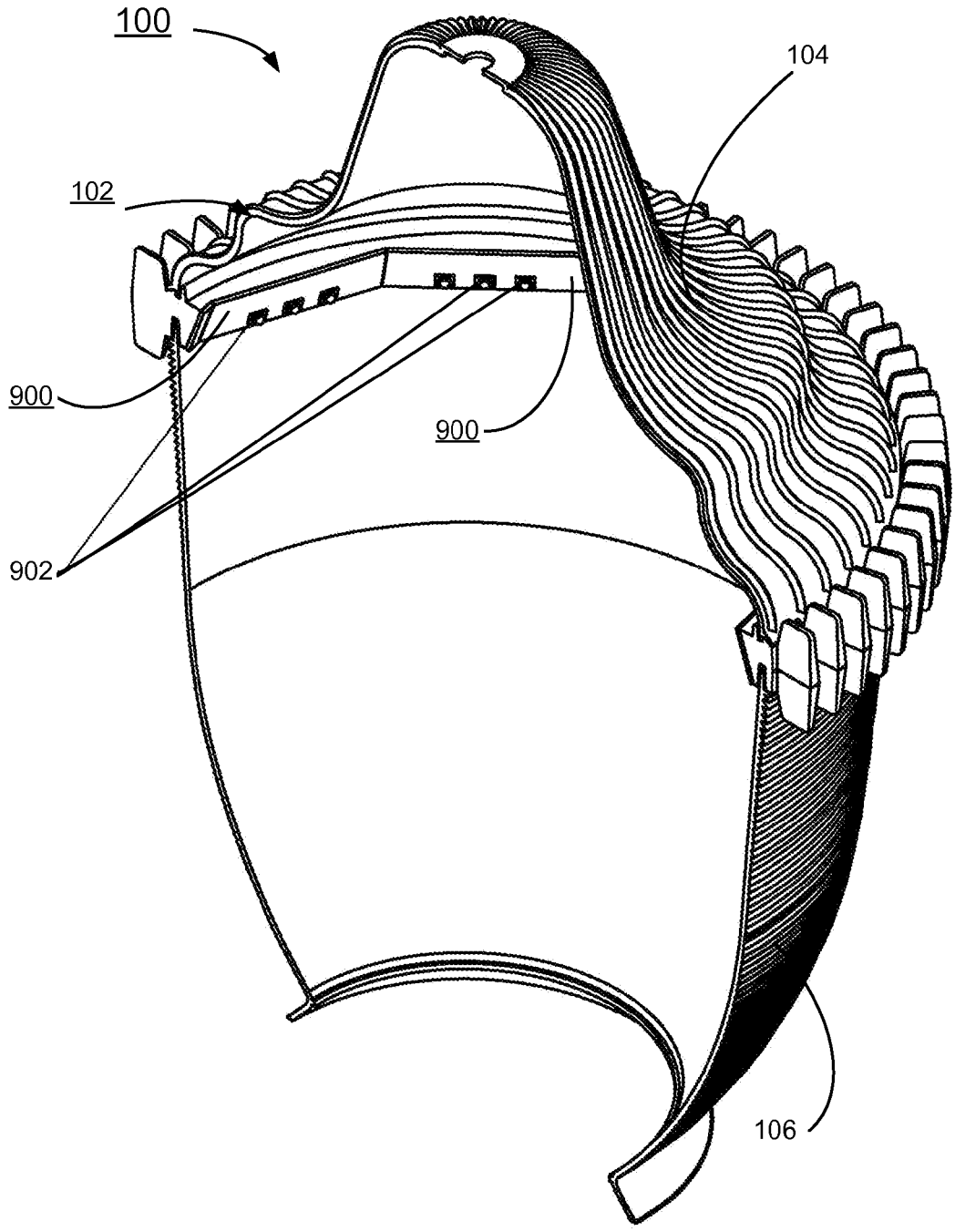
FIG. 9 is a fragmentary perspective sectional view illustrating light source boards, each including a predefined number of light emitting diodes (LEDs) of the lighting fixture of FIGS. 1 and 2 in accordance with the preferred embodiment.

Referring now to FIGS. 8 and 9, there is shown the heat sink member 102 of the lighting fixture 100 in accordance with the preferred embodiment. In FIG. 8, the heat sink member 102 is shown separately from the lighting fixture 100. In FIG. 9, there is shown a pair of light source boards generally designated by the reference character 900, each including a predefined number of light emitting diodes (LEDs) 902. The light source board 900 includes a metal core circuit board.

Figure 10:
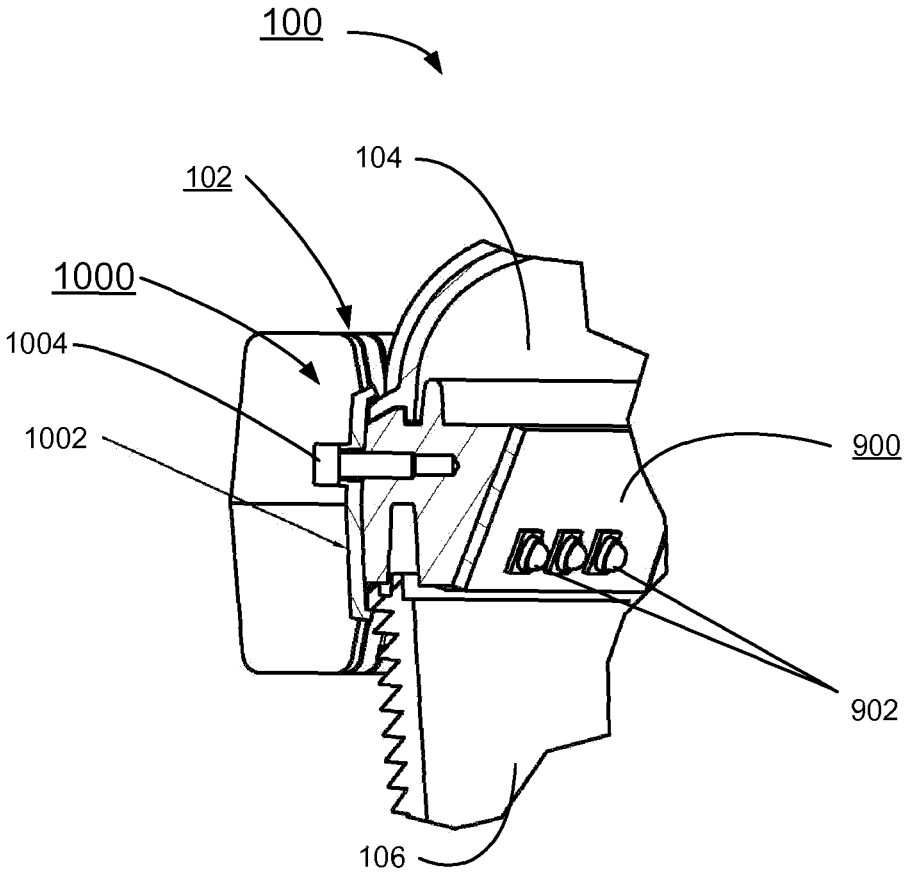
FIG. 10 is a fragmentary detail sectional view illustrating a mounting clip of the lighting fixture of FIGS. 1 and 2 in accordance with the preferred embodiment.

The ring shaped heat sink interior surface 114 has a plurality of mating surfaces 116, for example, twelve (12) mating interior surfaces 116. Referring also to FIG. 10, each mating surface 116 or side 116 being canted downwardly, for example, at an angle of 22 degrees. This angle dictates that the output of an LED 902 having a typical FWHM beam of between 90 and 140 degrees has its maximum candela running through a point on the centerline of the globe approximately 2.8" below the upper flange of the Model 425, which is the design light center for the Model 425 when using a traditional HID light source. Each of the 12-sided interior mating surfaces 116 is, for example, 3.65" long and 1.125" high. Each side 116 has a flat mating face for mounting of the respective LED boards 900.

The LED boards 900 including the metal core circuit board, such as 4 Cree XPG LEDs, are driven at 750 ma each with a total of 48 LEDs and 96 watts, not including the power supply. The fixture efficacy or lumens per watt for the lighting fixture 100 with these LEDs is greater than 60 lumens per watt. The optical efficiency of the lighting fixture 100 is greater than 70%.

The ring shaped heat sink member 102 is suited for dissipating at least 100 watts of heat, in an ambient temperature of 25 degrees C. and resulting in a maximum junction temperature of 75 degrees C. on the above referenced boards.

In FIG. 10, there is shown a fragmentary detail sectional view illustrating a mounting clip generally designated by the reference character 1000 of the lighting fixture 100 in accordance with the preferred embodiment. The mounting clip 1000 includes a bracket member 1002 mounted to the heat sink member 102 and a fastener 1004 for connecting the upper globe portion 104 and lower globe portion 106 of the lighting fixture 100. A plurality of mounting clips 1000, for example four (4) are provided with the heat sink member 102, attaching the upper globe portion 104 and lower globe portion 106 of the lighting fixture 100, and eliminating the need for a clamp band.

Figure 11:
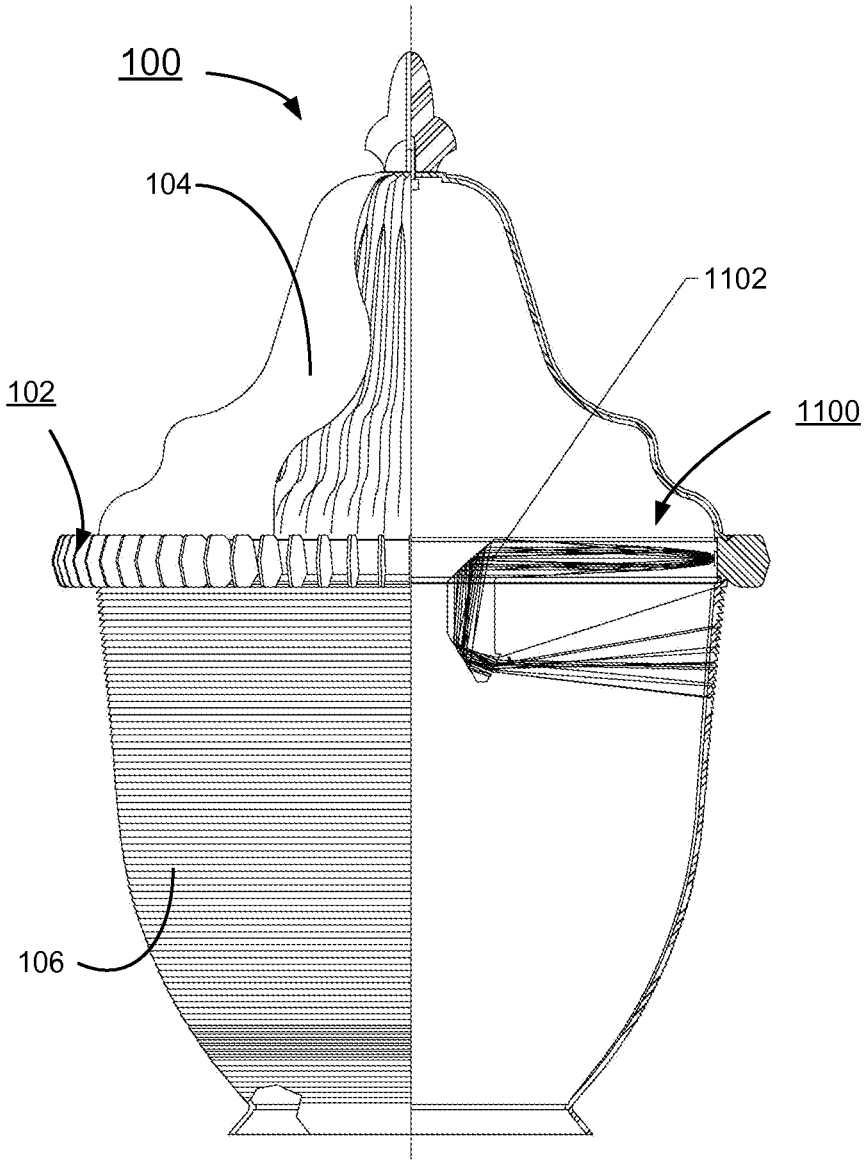
FIG. 11 is a fragmentary sectional view illustrating light rays with light pipe assembly used to redirect LED light output of the lighting fixture of FIGS. 1 and 2 in accordance with the preferred embodiment.

Referring now to FIG. 11 is a fragmentary sectional view illustrating light rays with a light pipe assembly generally designated by the reference character 1100 used to redirect LED light output of the lighting fixture 100 in accordance with the preferred embodiment. The light pipe assembly 1100 is provided within the lighting fixture 100. The light pipe assembly 1100 includes a plurality of light pipes 1102, each to redirect the output of an associated LED 902 to improve the light distribution of the lighting fixture 100.

Figure 12:
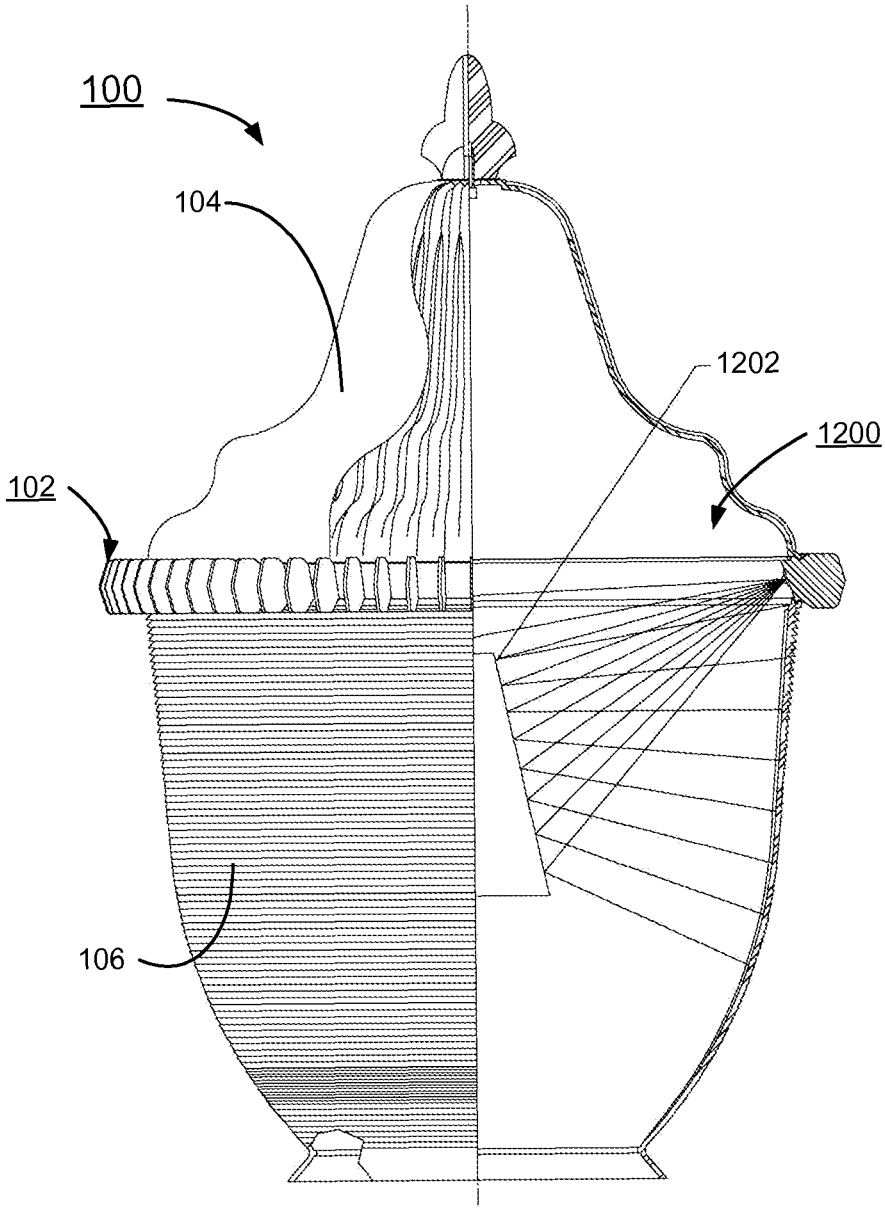
FIG. 12 is a fragmentary sectional view illustrating light rays with a reflector used to redirect LED light output of the lighting fixture of FIGS. 1 and 2 in accordance with the preferred embodiment.

Referring now to FIG. 12, there is shown a fragmentary sectional view illustrating light rays with a reflector generally designated by the reference character 1200 used to redirect LED light output of the lighting fixture 100 in accordance with the preferred embodiment. The reflector 1200 is provided within the lighting fixture 100 below the heat sink member 102. The reflector 1200 includes a predefined contour 1200 to provide directional illumination control. The reflector 1200 is made from a highly reflective aluminum member and preferably is anodized to maintain high reflectance of the metal.

Figure 13:
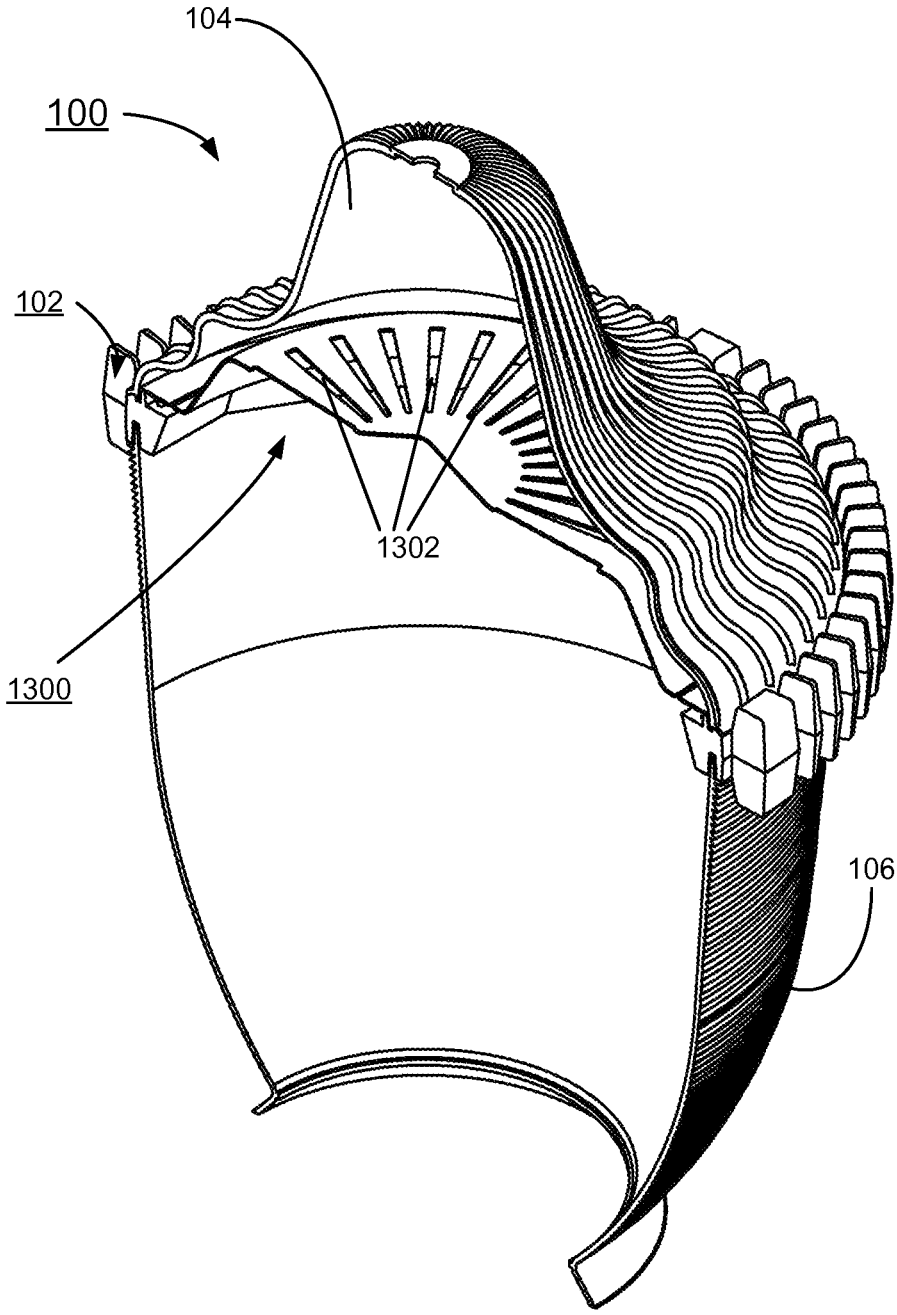
FIG. 13 is a fragmentary sectional view illustrating another reflector used to redirect LED light output of the lighting fixture of FIGS. 1 and 2 in accordance with another preferred embodiment.

Referring now to FIG. 13, there is shown a fragmentary sectional view illustrating another reflector generally designated by the reference character 1300 used to redirect LED light output of the lighting fixture 100 in accordance with another preferred embodiment. The reflector 1300 is provided within the lighting fixture 100 above the heat sink member 102 and includes a plurality of slots 1302 to provide a reduced upper controlled illumination component and also to provide a lower directional illumination control. The reflector 1300 is made from a highly reflective aluminum member and preferably is anodized to maintain high reflectance of the metal. The reflector 1300 provides control of the upper and lower illumination distribution, effectively increasing a downlight component, and selectively reducing an uplight component as determined by the multiple slots 1302 while maintaining a desired apparent glow of the upper globe portion 104.

Figure 14:
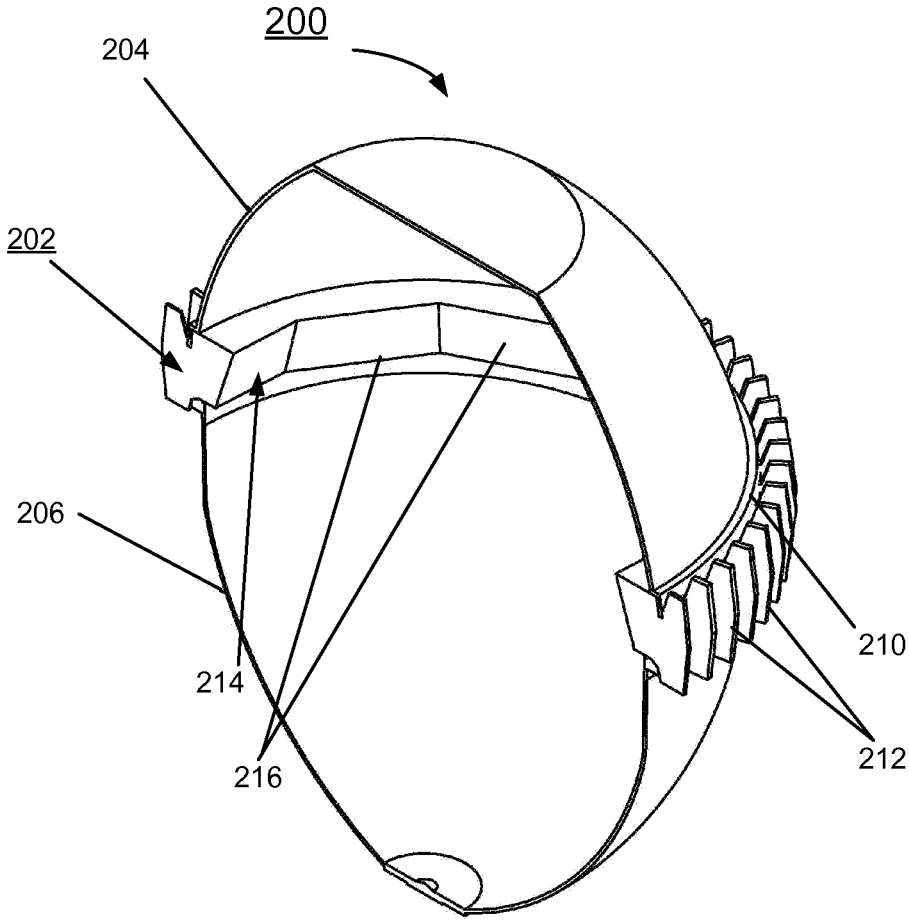
FIG. 14 is a fragmentary perspective sectional view illustrating another lighting fixture in accordance with a preferred embodiment.

Referring now to FIG. 14 there is shown another lighting fixture generally designated by the reference character 200 in accordance with a preferred embodiment. Lighting fixture 200 includes a heat sink member generally designated by the reference character 202 in accordance with a preferred embodiment. Lighting fixture 200 includes an upper reflector portion 204 and a lower globe portion 206, for example, of an outdoor lighting globe 200.

The heat sink member 202 includes a unitary band or ring member, which joins the upper reflector portion 204 and lower globe portion 206. An exterior surface 210 of the heat sink ring member 202 is disposed exterior of the lighting fixture 200 and is exposed to the air for optimal cooling. The exterior surface 210 of the heat sink member 202 includes a plurality of integrally formed, outwardly extending vertical exterior fins 212 for enhanced thermal transfer performance.

An inside surface 214 of the heat sink member 202 has predetermined surfaces 216 which allow selective positioning of the LEDs (not shown in FIG. 14) to provide optimal lumen performance.

The heat sink member 202 is formed of a selected thermally conductive material, such as cast aluminum and is either painted or anodized to protect the heat sink member from corrosion. The heat sink member 202 also can be formed of copper or other metal. The upper reflector portion 204 is formed, for example, of spun or hydroformed aluminum. The lower globe portion 206 is formed of a substantially transparent light transmitting material, such as an acrylic or similar material, for example, including prismatic elements (not shown in FIG. 14) formed on an inside surface. The upper reflector portion 204 and lower globe portion 106 are implemented, for example, with an A.L.P. LexaLite Model 110 top and a LexaLite Model 110, manufactured and sold by A.L.P. Lighting & Ceiling Products, Inc. of Niles, Ill.

Figure 15:
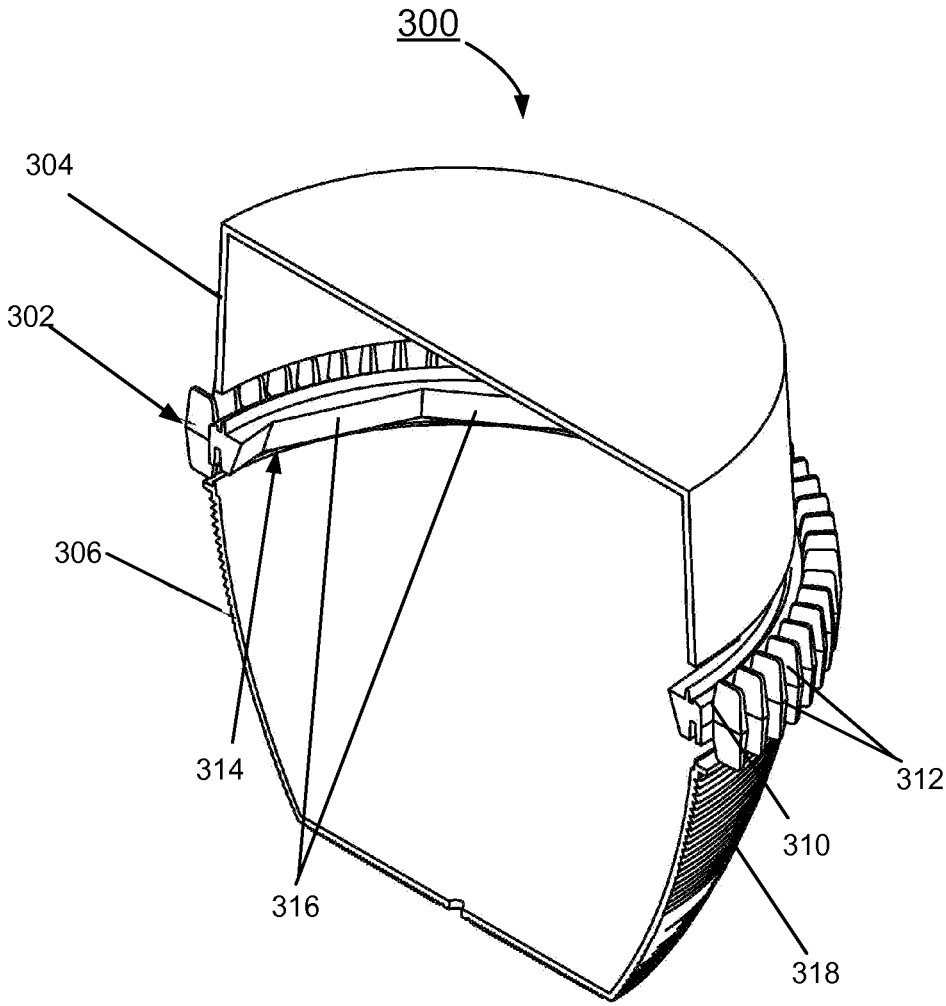
FIG. 15 is a fragmentary perspective sectional view illustrating another lighting fixture in accordance with a preferred embodiment.

Referring now to FIG. 15 there is shown another lighting fixture generally designated by the reference character 300 in accordance with a preferred embodiment. Lighting fixture 300 includes a heat sink member generally designated by the reference character 302 in accordance with a preferred embodiment. Lighting fixture 300 includes an upper reflector portion 304 and a lower globe portion 306, for example, of an outdoor lighting fixture 300.

The heat sink member 302 includes a unitary band or ring member, which joins the upper reflector portion 304 and lower globe portion 306. An exterior surface 310 of the heat sink ring member 302 is disposed exterior of the lighting fixture 300 and is exposed to the air for optimal cooling. The exterior surface 310 of the heat sink member 302 includes a plurality of integrally formed, outwardly extending vertical exterior fins 312 for enhanced thermal transfer performance.

An inside surface 314 of the heat sink member 302 has predetermined surfaces 316 which allow selective positioning of the LEDs (not shown in FIG. 15) to provide optimal lumen performance.

The heat sink member 302 is formed of a selected thermally conductive material, such as cast aluminum and is either painted or anodized to protect the heat sink member from corrosion. The heat sink member 302 also can be formed of copper or other metal. The upper reflector portion 304 is formed, for example, of cast aluminum or stamped steel. The lower globe portion 306 is formed of a substantially transparent light transmitting material, such as an acrylic or similar material, for example, including prismatic elements 318 formed on the outside surface. The upper reflector portion 304 and lower globe portion 306 are implemented, for example, with an A.L.P. LexaLite Model 210 top and a LexaLite Model 210, manufactured and sold by A.L.P. Lighting & Ceiling Products, Inc. of Niles, Ill.

Figure 16:
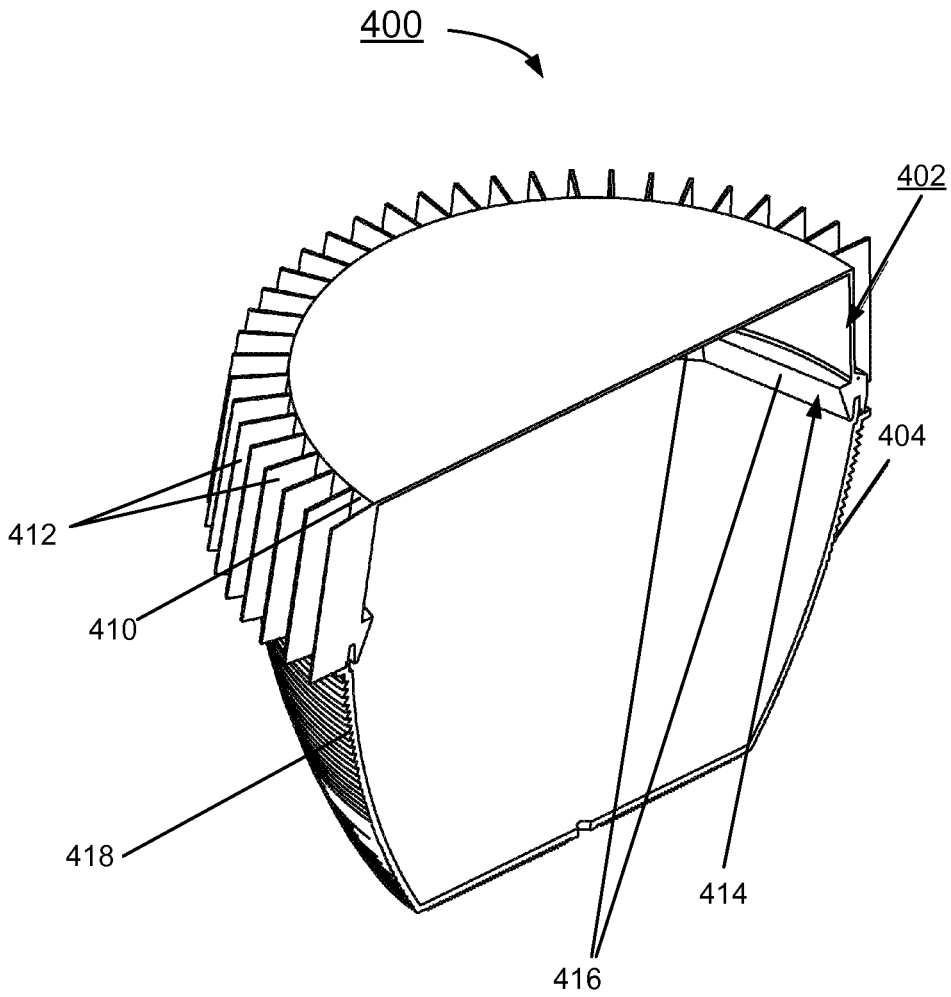
FIG. 16 is a fragmentary perspective sectional view illustrating another lighting fixture in accordance with a preferred embodiment.

Referring now to FIG. 16 there is shown another lighting fixture generally designated by the reference character 400 in accordance with a preferred embodiment. Lighting fixture 400 includes a heat sink member generally designated by the reference character 402 in accordance with a preferred embodiment. The heat sink member 402 defines a unitary upper reflector portion 402. Lighting fixture 400 includes a lower globe portion 404, for example, of an outdoor lighting globe 400. An exterior surface 410 of the heat sink member 402 includes a plurality of integrally formed, outwardly extending vertical exterior fins 412 for enhanced thermal transfer performance.

An inside surface 414 of the heat sink member 402 has predetermined surfaces 416 which allow selective positioning of the LEDs (not shown in FIG. 16) to provide optimal lumen performance.

The heat sink member 402 is formed of a selected thermally conductive material, such as cast aluminum and is either painted or anodized to protect the heat sink member from corrosion. The heat sink member 402 also can be formed of copper or other metal, such as stamped steel. The lower globe portion 406 is formed of a substantially transparent light transmitting material, such as an acrylic or similar material, for example, including prismatic elements 418 formed on the outside surface.

Figure 17:
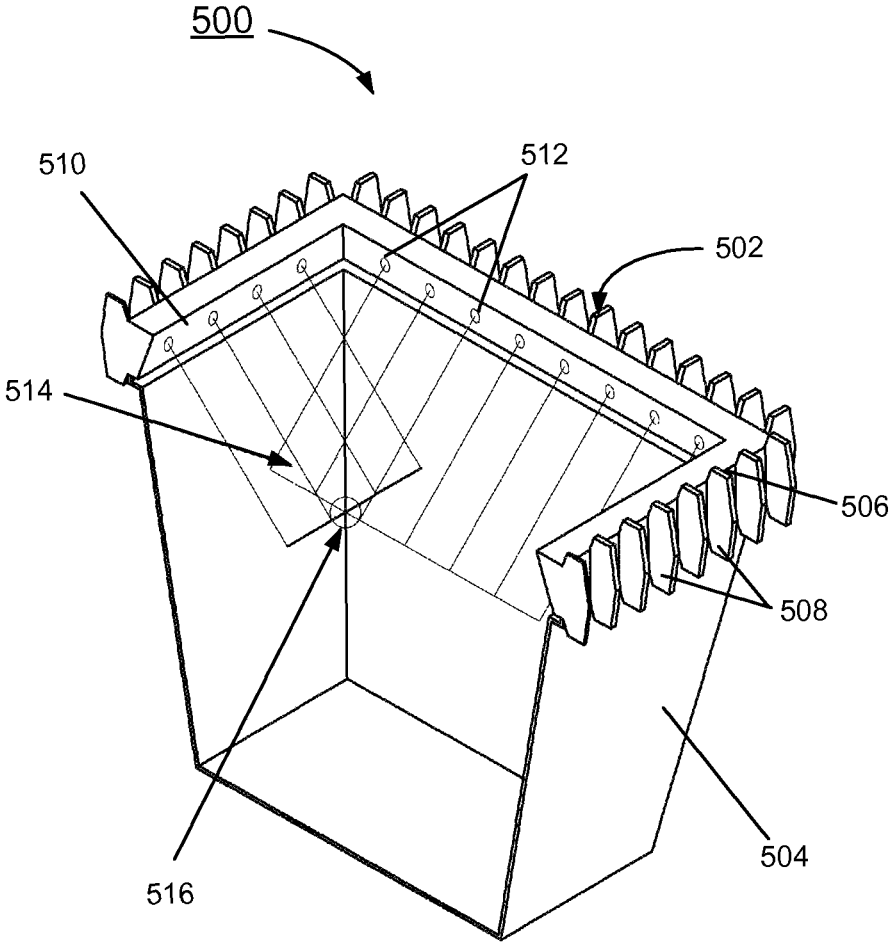
FIG. 17 is a fragmentary perspective sectional view illustrating another lighting fixture in accordance with a preferred embodiment.

Referring now to FIG. 17 there is shown another lighting fixture generally designated by the reference character 500 in accordance with a preferred embodiment. Lighting fixture 500 includes a heat sink member generally designated by the reference character 502 in accordance with the preferred embodiment. The heat sink member 502 is used with a selected upper fixture portion (not shown in FIG. 17). Lighting fixture 500 includes a lower four sided polygon, generally rectangular or lantern body portion 504, for example, of an outdoor lantern style lighting fixture 500.

An exterior surface 506 of the heat sink member 502 includes a plurality of integrally formed, outwardly extending vertical exterior fins 508 for enhanced thermal transfer performance. The heat sink member 502 includes an inside surface 510 having predetermined angle which allow selective positioning of the LEDs 512 to provide optimal lumen performance. All the LEDs 512 have beam centers aimed to cross in a plane generally designated by the reference character 514 that is on a designed light center generally designated by the reference character 516.

The heat sink member 502 is formed of a selected thermally conductive material, such as cast aluminum and is either painted or anodized to protect the heat sink member from corrosion. The heat sink member 502 also can be formed of copper or other metal, such as stamped steel. The lower lantern body portion 504 is formed of a substantially transparent light transmitting material, such as a clear glass, white or frosted glass or similar material.

While the present invention has been described with reference to the details of the embodiments of the invention shown in the drawing, these details are not intended to limit the scope of the invention as claimed in the appended claims.

What is claimed is:

1. A lighting fixture comprising:

an upper globe portion;

a lower globe portion; said upper globe portion and said lower globe portion being formed of a substantially transparent light transmitting material for emitting light;

a unitary ring heat sink member; said unitary ring heat sink member including an outside surface; said outside surface being disposed exterior of the lighting fixture;

a plurality of fins extending outwardly from said outside surface integrally formed with said unitary ring heat sink member and having a selected size and configuration extending beyond an maximum perimeter of both said upper globe portion and said lower globe portion for providing enhanced thermal transfer performance;

an inside surface of said heat sink member being disposed inside of the lighting fixture; said inside surface including a plurality of mating surface portions having a flat mating face configured for mating engagement with a respective light source board, and for selectively positioning of said light source boards; and said heat sink member joining said upper globe portion and said lower globe portion of the lighting fixture.

2. The lighting fixture as recited in claim 1 includes a plurality of mounting brackets mounted to said heat sink member and mounted to said upper globe portion and said lower globe portion of the lighting fixture.

3. The lighting fixture as recited in claim 1 includes a plurality of light source boards, and wherein each of the light source boards includes a predefined number of light emitting diodes (LEDs), and includes an optical efficiency of greater than 70%.

4. The lighting fixture as recited in claim 1 includes a predefined number of light emitting diodes (LEDs) and a reflector disposed inside the lighting fixture to redirect the LED light output.

5. The lighting fixture as recited in claim 4 wherein said reflector includes a predefined contour to provide directional illumination control.

6. The lighting fixture as recited in claim 4 wherein said reflector is positioned above said heat sink member and said reflector includes a predefined contour and a plurality of slots to provide both upward and downward directional illumination control.

7. The lighting fixture as recited in claim 4 wherein said reflector reduces an uplight component and increases a downlight component.

8. The lighting fixture as recited in claim 4 wherein said reflector includes a highly reflective aluminum member.

9. The lighting fixture as recited in claim 1 wherein said mating surface portions configured for mating engagement with a respective light source boards are canted downwardly.

10. The lighting fixture as recited in claim 1 wherein said mating surface portions are canted downwardly at an angle of approximately 22 degrees.

11. The lighting fixture as recited in claim 1 wherein said mating surface portions configured for mating engagement with a respective light source boards are canted at an angle to direct an LED light output.

12. The lighting fixture as recited in claim 1 includes a predefined number of light emitting diodes (LEDs) and wherein an LED light output of said light emitting diodes (LEDs) is directed toward a side of the lower globe portion generally opposite to a side where said light emitting diodes (LEDs) are located.

13. The lighting fixture as recited in claim 1 includes a predefined number of light emitting diodes (LEDs) and wherein said light emitting diodes (LEDs) are located symmetrically about an interior perimeter of said heat sink member.

14. The lighting fixture as recited in claim 1 wherein said mating surface portions configured for mating engagement with a respective light source boards are canted at an angle to direct a LED light output proximate to a point on a light center of the fixture.

15. The lighting fixture as recited in claim 1 wherein said inside surface of said heat sink member being disposed at a selected angle to direct a LED light output to cross in a plane proximate a light center of the fixture.

16. A lighting fixture comprising:

an upper light transmitting portion;

a lower light transmitting portion; said upper light transmitting portion and said lower light transmitting portion for emitting light;

a unitary ring heat sink member; said heat sink member including an outside surface; said outside surface being disposed exterior of the lighting fixture;

a plurality of fins extending outwardly from said outside surface integrally formed with said unitary ring heat sink member and having a selected size and configuration extending beyond an maximum perimeter of both said upper light transmitting portion and said lower light transmitting portion for providing enhanced thermal transfer performance;

an inside surface of said heat sink member being disposed inside of the lighting fixture; said inside surface supporting a predefined number of light emitting diodes (LEDs) for providing a major distribution of an emitted LED light output directly onto said lower light transmitting portion, without using focusing lenses or reflectors; and said unitary ring heat sink member joining said upper light transmitting portion and said lower light transmitting portion of the lighting fixture.

17. The lighting fixture as recited in claim 16 includes a reflector disposed inside the lighting fixture to redirect the LED light output.

18. The lighting fixture as recited in claim 17 wherein said reflector includes a predefined contour to provide directional illumination control.

19. The lighting fixture as recited in claim 17 wherein said reflector includes a highly reflective aluminum member.

20. The lighting fixture as recited in claim 16 wherein said inside surface includes mating surface portions configured for mating engagement with at least one light source board, and said mating surface portions are canted downwardly.

21. The lighting fixture as recited in claim 16 wherein said light emitting diodes (LEDs) are located symmetrically about an interior perimeter of said unitary ring heat sink member.

22. The lighting fixture as recited in claim 16 wherein said inside surface of said unitary ring heat sink member being disposed at a selected angle to direct an LED light output to cross in a plane proximate to a light center of the fixture.

* * * * *